US009558725B2

(12) United States Patent
Uesawa

(10) Patent No.: US 9,558,725 B2
(45) Date of Patent: Jan. 31, 2017

(54) DISK, WIND INSTRUMENT, COUNTER PIECE, AND METHOD OF PRODUCING THE DISK

(71) Applicant: Haruo Uesawa, Munich (DE)

(72) Inventor: Haruo Uesawa, Munich (DE)

( * ) Notice: Subject to any disclaimer, the term of this patent is extended or adjusted under 35 U.S.C. 154(b) by 0 days.

(21) Appl. No.: 14/469,551

(22) Filed: Aug. 26, 2014

(65) Prior Publication Data

US 2014/0360336 A1 Dec. 11, 2014

Related U.S. Application Data

(63) Continuation of application No. PCT/EP2013/053825, filed on Feb. 26, 2013.

(30) Foreign Application Priority Data

Feb. 27, 2012 (EP) ..... 12157166

(51) Int. Cl.
*G10D 9/04* (2006.01)
*G10D 7/00* (2006.01)

(52) U.S. Cl.
CPC ..... *G10D 9/04* (2013.01); *G10D 7/005* (2013.01); *G10D 9/043* (2013.01)

(58) Field of Classification Search
CPC ..... G10D 9/04; G10D 7/005; G10D 9/043
USPC ..... 84/385 P
See application file for complete search history.

(56) References Cited

U.S. PATENT DOCUMENTS

| | | | | |
|---|---|---|---|---|
| 3,421,399 | A | 1/1969 | Greenleaf et al. | |
| 4,453,444 | A | 6/1984 | Valentino | |
| 4,967,632 | A | 11/1990 | Etheredge | |
| 5,717,151 | A | 2/1998 | Straubinger | |
| 7,396,984 | B2 * | 7/2008 | Straubinger | G10D 9/043 84/385 P |
| 2005/0235807 | A1 | 10/2005 | Kraus | |
| 2008/0028914 | A1 | 2/2008 | Straubinger | |

FOREIGN PATENT DOCUMENTS

| | | | |
|---|---|---|---|
| DE | 29913239 U1 * | 2/2000 | G10D 9/043 |
| FR | 1.304.749 | 9/1962 | |
| JP | 47-008733 | 3/1972 | |

OTHER PUBLICATIONS

Japanese Office Action for corresponding JP Application No. 2014-557090, Feb. 4, 2016 (w/ English machine translation).
Japanese Office Action for corresponding JP Application No. 2014-557090, Jul. 23, 2015 (w/ English machine translation).
Written Opinion for corresponding International Application No. PCT/EP2013/053825, Jun. 17, 2013.
International Search Report for corresponding International Application No. PCT/EP2013/053825, Jun. 17, 2013.
Extended European Search Report for corresponding EP Application No. 12157166.5-2225, Jun. 29, 2012.
(Continued)

*Primary Examiner* — Jianchun Qin
(74) *Attorney, Agent, or Firm* — Mori &Ward, LLP

(57) ABSTRACT

A disk for stabilizing a pad assembly in a key cup for closure of a wind instrument tone hole includes an integral body made of a material which is in a solid state at a room temperature and in a malleable state at a predetermined temperature higher than the room temperature.

32 Claims, 1 Drawing Sheet

(56) References Cited

OTHER PUBLICATIONS

European Office Action for corresponding EP Application No. 13712491.3-1910, Jan. 26, 2016.
Retrieved from the Internet web site "the-clarinets.net", The Clarinet—how to fix, [URL: http://www.the-clarinets.net/english/clarinet-how-to-fix.html], XP0055241748, [online], [retrieved on Jan. 15, 2016].
A. H. Warth "*The Chemistry and Technology of Waxes*", Second Edition, Reinhold Publishing Corp., (1956), New York.
H. Bennet "*Industrial Waxes*", vol. 1, 1963, Chemical Publishing Co., New York.
Product information website for Mitsui Hi-WAX™, Retrieved from the Internet: <URL: http://www.mitsuichem.com/service/polyurethane/coatings/hi-wax/spec.htm>, [online] Retrieved on Feb. 22, 2012.
Product information website of Nippon Seiro Co., Ltd., Retrieved from the Internet: <URL: http://www.seiro.co.jp/e/product.html>, 2008, [online] Retrieved on Feb. 22, 2012.
Gesswein's MSDS, Retrieved from the Internet: <URL: http://www.gesswein.com/images/MSDS/File-A-Wax,-Green.pdf>, [online] last updated 2010.
Freeman's Technical Data Sheet, Retrieved from the Internet: <URL: http://www.freemanwax.com/ferris-file-a-wax-green/> [online] last updated Apr. 25, 2013 based on the information retrieved from <URL: http://www.sitelevel.com/query?crid=44xz26rd&query=ferris-file-a-wax-green>.
European Office Action for corresponding EP Application No. 13712491.3-1910, Apr. 4, 2016.
Extended European Search Report for corresponding EP Application No. 16173891.9-1910, Oct. 28, 2016.

* cited by examiner

DISK, WIND INSTRUMENT, COUNTER PIECE, AND METHOD OF PRODUCING THE DISK

CROSS-REFERENCE TO RELATED APPLICATIONS

The present application is a continuation application of International Application No. PCT/EP2013/053825, filed Feb. 26, 2013, which claims priority to European Patent Application No. 12157166.5, filed Feb. 27, 2012. The contents of these applications are incorporated herein by reference in their entirety.

BACKGROUND OF THE INVENTION

Field of the Invention

The present invention relates to a disk, a wind instrument, a counter piece, and a method of producing the disk.

Discussion of the Background

Musical wind instruments such as brass instruments and woodwind instruments, particularly flutes, allow the musician to play different tones by opening and closing a plurality of tone holes with his fingers. Typically, the musician places his/her fingers on the plural keys of the instrument's key mechanism or key work which allows, upon direct or indirect (via a lever) actuation of the musician's fingers, for placing each of a plurality of key cups onto the plural tone holes.

The sound quality of the wind instrument largely depends on the exactness of the closure of its tone holes by the key cups. Ideally, the cup should close the tone hole in an airtight manner so that the instrument main body and the cup vibrate together like a single uniformly sounding body. If the key cup does not fit precisely on the tone hole, a portion of air could emanate from the closed hole during playing, thereby producing some undesirable whistling sound. In order to ensure an airtight fitting of the cup on the tone hole, the cup usually contains a pad assembly comprising a felt body coated with a resin film or some sort of animal skin.

In order to better support the pad assembly within the key cup it is also known to put a stabilising disk between the inner bottom wall of the cup and the pad assembly. The stabilising disk is typically made of a plastics material formed by injection moulding or the like. Such stabilising or backing disks improve the seating of the pad assembly within the cup and achieve a reasonably tight closure of the tone hole by the key cup even when the wind instrument is used for a long lifetime.

A problem arises from the fact that the inner bottom wall of the cup mostly has a non-flat surface. This means that the inner bottom wall has some unevenness in the sense that it is not rotationally symmetrical with respect to its centre point. This non-flatness or unevenness can be originally existent due to an imperfect machining or working process of the cup or arise during use of the instrument as a common wear behaviour. The uneven surface of the inner bottom wall leads to a tilting movement of the stabilising disk and the pad assembly within the cup. As a result, the cup fails to close the tone hole in an airtight manner.

It can be attempted to avoid this problem by increasing the pressure by which the pad assembly rests on the tone hole, but this causes further problems because of the higher pressing force to be applied by the musician for closing the cups via the key mechanism and because of the unbalanced load or pressure applied to the pad assembly along its circumference.

In order to balance out the uneven surface structure of the inner bottom wall in the cup, specialists for repairing musical wind instruments have developed a method of attaching thin shimming elements of cardboard material or the like to those circumferential portions of the pad assembly which are opposite to the deeper portions of the uneven surface of the bottom wall within the cup. Thereby, the unevenness can be balanced out and the instrument's sound quality can be restored. However, this repairing process is very cumbersome and time-consuming and requires a high level of skills and expertise. It would thus be desirable to find an easier and more efficient way of balancing out the non-flat surface of the inner bottom wall in the cup.

It has previously been known to fill the inner bottom wall with bees wax or sealing wax (such as shellac) before inserting the pad assembly. U.S. Pat. No. 3,421,399 and FR1304749 relate to this conventional technology. However, those waxes are malleable (i.e. in a molten or softened state, or plastically ductile) at relatively low temperatures around room temperature so that backing disks made therefrom give no durable stabilisation of the pad assembly during use of the wind instrument and lead to undesired sound characteristics of the instrument. Also, due to its insufficiently stable backing by the layer of bees wax or sealing wax, the pad assembly often gets tilted and non-uniformly worn during actual use in the key cup.

A problem arises when repairing a musical instrument; namely the conventional stabilising disk attached onto the inner bottom wall of the cup by means of a sealing wax or a glue, or a stabilising disk tightly stuck by itself onto the inner bottom wall of the cup due to deterioration of the stabilising disk material during the use of the musical instrument, needs to be completely removed from the surface of the inner bottom wall of the cup. However, removal of such stabilising disk is often not easy even for the repair specialist because it is too tightly adhered or stuck onto the inner bottom wall of the cup.

U.S. Pat. No. 5,717,151 discloses a stabilising disk consisting of two components, an upper component formed of an adjusting agent, particularly a hot melt adhesive, and a second component formed of a metal or polymer material. The first and second components are glued together. The adjusting agent is poured in its fluid state into the cup and the second component is then pressed thereon to establish a gluing connection between the two components. There are grooves or porous regions formed in the second component into which the adjusting agent is pressed during the gluing step. The pressing force is exerted by an adjusting disk which is driven by magnetic or vacuum forces.

A disadvantage of the above described stabilising disk known from U.S. Pat. No. 5,717,151 resides in its complicated setup of two components and the fact that the adjusting agent has a sticky consistence at room temperature which makes it difficult to remove the stabilising disk entirely from the cup in maintenance works. Further, the pressing of the two components by vacuum or magnetic forces via the adjusting disk is rather complicated and impedes manual fine tuning. It would therefore be desirable to have a less complicated manufacturing method by which a stabilising disk is formed as an integral body. The stabilising disk should have a shape which is complementary to the uneven inner surface of the cup and which is nevertheless readily removable from the cup in the manufacturing, repairing or maintenance process of the wind instrument.

Another problem generally impairing the tone hole closure by the key cup resides in the fact that the key mechanism or key work does not work so precisely that the key cup comes at rest on the tone hole in a perfectly horizontal orientation, i.e. an orientation in which the pad assembly in the cup is completely parallel to the outer circumference of the tone hole. More likely, the pad assembly reaches the tone hole's outer circumferential portion at a slightly inclined angle which means a rotationally asymmetric closure of the tone hole and a non-uniform pressing force against the pad assembly during use. This inclined angle might result from long-term use of the instrument or be originally existent due to an imperfect constructional manufacturing process.

As a result of the above-explained inclined angle, even a stabilising disk which would perfectly balance out any unevenness (non-flatness) in the surface structure of the inner bottom wall of the cup would lead to a non-perfect horizontal closure of the tone hole by the pad assembly. The pad assembly would then perfectly rest in the cup in a horizontal fashion but be positioned obliquely onto the tone hole during use of the wind instrument due to the imprecise mechanism by which the key cup is hinged to the key work.

Also, as a result of the above-mentioned problems, the quality of the tone generated from the instrument by a player sometimes becomes inferior or too metallic, or the volume of the sound becomes lowered.

SUMMARY OF THE INVENTION

According to one aspect of the present invention, A disk is an integral body made of a material which is in a solid state at a room temperature and in a malleable state at a predetermined temperature higher than the room temperature to stabilise a pad assembly in a key cup for closure of a wind instrument tone hole.

According to another aspect of the present invention, a wind instrument has a plurality of tone holes and a plurality of key cups for closure of the plurality of tone holes, and at least one of the plurality of key cups includes a pad assembly and the above described disk.

According to further aspect of the present invention, a counter piece has at least two disk-shaped portions, i.e. a first disk-shaped portion and a second disk-shaped portion. The second disk-shaped portion is concentrically arranged with the first disk-shaped portion and has a smaller diameter than the first disk-shaped portion. The second disk-shaped portion is to be positioned in a wind instrument tone hole during a manufacturing process of a stabilising disk adapted to stabilise a pad assembly in a key cup for closure of the tone hole.

According to the other aspect of the present invention, in a method of producing a disk, a precursor disk is positioned in a key cup. The precursor disk is an integral body made of a disk material which is in a solid state at a room temperature and in a malleable state at a predetermined temperature higher than the room temperature. A releasing material is optionally provided, preferably as a thin layer, between a bottom wall of the key cup and an upper surface of the precursor disk. A counter piece is positioned in a tone hole of a wind instrument. A thin layer to retard a heat-transfer is optionally placed between a lower surface of the precursor disk and the counter piece and/or a releasing material is optionally provided, preferably, as a thin layer, between the lower surface of the precursor disk and an upper surface of the counter piece. The tone hole is closed by the key cup with the counter piece being positioned between the tone hole and the key cup. The precursor disk is heated to the predetermined temperature at which the disk material gets into a malleable state. The key cup is pressed against the tone hole to reform the precursor disk into the disk. The disk is cooled to a temperature below the predetermined temperature so that the disk material gets into a solid state. The disk is to stabilise a pad assembly in the key cup for closure of a wind instrument tone hole.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1A:
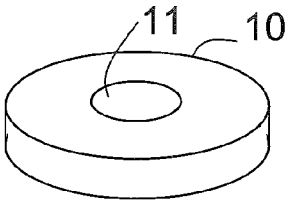
FIG. 1A shows a perspective view of a precursor disk for manufacturing the stabilising disk of an embodiment of the present invention.

The embodiments will now be described with reference to the accompanying drawings, wherein like reference numerals designate corresponding or identical elements throughout the various drawings.

According to the illustrative but non-limiting embodiment shown in the present Figures, the precursor disk 10 is a thin plate of a disk material, such as a hard wax, having two flat, preferably uniformly flat, surfaces. It is also possible to recycle an old stabilising disk which had been prepared earlier according to the production method of the present invention but is no longer needed. The precursor disk 10 has a centrally arranged throughhole 11, the size of which may vary depending on the particular mechanical set-up of the key cup for which a suitable stabilising disk should be manufactured.

Taking typical dimensions suitable for a flute's key cup as an example, the precursor disk has a diameter of 15 to 20 mm and a thickness of 1 to 2 mm, or even thicker such as 4 to 5 mm depending on the type of tone hole and/or depending on the instrument.

In this preferred example, Ferris File-A-Wax Green of the company Gesswein is used as the disk material. It is in a non-malleable rigid state at room temperature and reaches good malleability at around 70 to 80° C. Its melting point is around 114-119° C.

Ferris File-A-Wax Green sold by Freeman which is a waxy solid, made of polyethylene having a melting point of 109° C., a specific gravity of 0.92 and Shore D Hardness of 55 can also be among the preferred examples of the present invention.

Figure 1B:
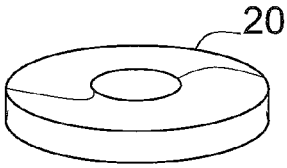
FIG. 1B shows a perspective view of the stabilising disk according to an embodiment of the present invention.
Figure 1C:
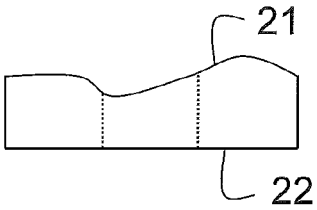
FIG. 1C shows a side elevational view of the stabilising disk according to the embodiment shown in FIG. 1B.

By the manufacturing process explained in further detail below as an embodiment of the present invention applied to a flute as an embodiment of a wind instrument, a stabilising disk 20 as shown in present FIG. 1B is obtained. This disk 20 has a non-flat, particularly rotationally asymmetric, upper surface 21 which is shaped to fit exactly to the uneven surface of the inner bottom wall of a key cup of the instrument. The lower surface 22 of the stabilising disk 20 keeps its flat structure. The two differently shaped surfaces 21, 22 of the stabilising disk 20 are illustrated in present FIG. 1C. The unevenness of the upper surface 21 shown therein is exaggerated for illustration purposes.

Figure 2:
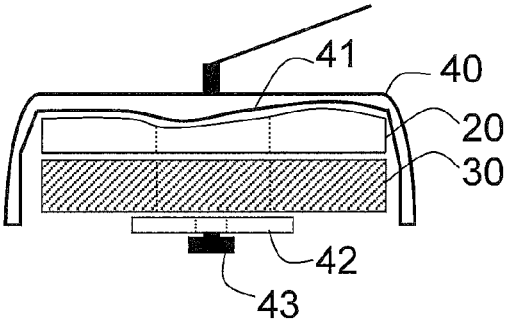
FIG. 2 shows a cross-sectional view of a key cup including a key pad assembly and the stabilising disk according to an embodiment of the present invention.

FIG. 2 schematically shows the arrangement of the stabilising disk 20 between the pad assembly 30 and the inner bottom wall 41 of the key cup 40. The shown example illustrates a closed cup. Of course, the embodiment of the invention also works for ring cups having a central opening to be closed by the musician's finger when being actuated. As shown in the Figure, the uneven upper surface 21 of the stabilising disk 20 exactly fits to the individually shaped uneven surface of the inner bottom wall 41 of the cup 40. Again, the unevenness of the inner bottom wall 41 shown therein is exaggerated for illustration purposes.

The pad assembly 30 which typically comprises a ring-shaped felt covered with a resin film or some sort of animal skin is put on the lower flat surface 22 and fixed to the cup 40 by a washer 42 and a screw 43 which is fixed to the cup 40 by being screwed into a centrally arranged nut (not shown) of the cup 40. The lower side of the pad assembly 30 is configured to air-tightly close the tone hole of the wind instrument when actuated by the musician via the key mechanism.

The manufacturing method of the stabilising disk according to one preferred embodiment of the present invention takes advantage of the particular material characteristics of the disk material which is preferably a hard wax material. The precursor disk 10 is placed into the cup 40 to rest with its upper surface against the uneven surface of the inner bottom wall 41 of the cup 40. By heating up the cup 40 (with a Bunsen burner or any other applicable heating measure) to a temperature of about 70 to 80° C., or to a temperature at which the disk material reaches a malleable state, the precursor disk 10 reaches its malleable state and is being moulded to fit to the shape of the inner bottom wall 41, while a predetermined pressure is applied to the precursor disk 10 from at least one side of the precursor disk, preferably from the other side (i.e. from the lower surface) of the precursor disk. The predetermined pressing force to be applied during the moulding process to the precursor disk 10 is of a strength which is enough to deform the precursor disk 10 into a stabilising disk having its upper surface shaped so as to be complementary to the uneven surface of the inner bottom wall 41 of the cup 40.

Figure 3A:
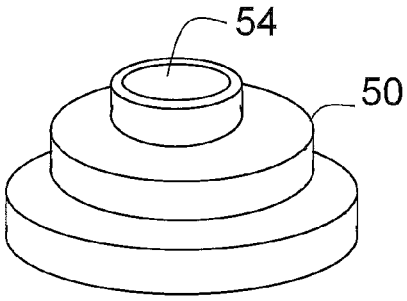
FIG. 3A shows a perspective view of a counter piece according to an embodiment of the present invention.
Figure 3B:
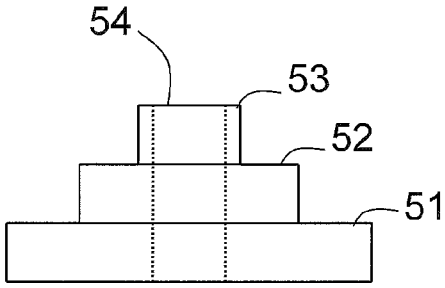
FIG. 3B shows a side elevational view of the counter piece shown in FIG. 3A.

According to a most preferable embodiment of the present invention, the predetermined pressing force during the moulding process is exerted via the specially configured counter piece 50 shown in present FIGS. 3A and 3B. The counter piece 50 has a first disk-shaped portion 51, a second disk-shaped portion 52, and optionally a third disk-shaped portion 53 which are centrally arranged to each other around a central throughhole 54. According to a modified and preferable embodiment, the counter piece 50 may further have a fourth disk-shaped portion 55 which is explained in detail below with reference to FIG. 5.

The counter piece 50 is an integral body made from a hard material. The counter piece 50 can be made of any material as long as it has a lower hardness than the material of the hole of the wind instrument to which the counter piece 50 is applied during the moulding process of the stabilising pad 20 of the present invention. Examples of such hard materials include, but are not limited to, a metal, metal alloy, ceramic, composite ceramic, glass, graphite, composite graphite, carbon fiber composite, plastic, composite plastic or thermosetting resin materials as long as it has a lower hardness than the material of the hole of the wind instrument. Specific examples of plastics as such hard materials include, but are not limited to, polycarbonate, polymethylmethacrylate, polyoxymethylene acetal, 4-methylpenten-1 polymer or copolymer.

If heating is applied from the counter piece side, it is desirable that the counter piece 50 has good heat conductivity so that enough heat is supplied through the counter piece 50 to the whole portion of the precursor disk 10 which is eventually converted to a stabilising disk 20 having a non-flat upper surface particularly complementary to the non-flat surface of the inner bottom wall 41 of the cup 40.

If the heating is applied from the cup side, the heat-conducting property of the counter piece 50 is not a concern to be addressed, but it is desirable that the counter piece 50 is made of the material as exemplified above such that it does not adversely affect the distribution of the applied heat from the cup side in the precursor disk 10 to attain the surface structure formation of the upper surface 21 of the stabilising disk 20 particularly complementary to the non-flat surface of the inner bottom wall 41 of the cup 40.

If the heating is applied from the cup 40 side, the thin layer placed between the lower surface of the stabilising disk 20 and the upper surface of the counter piece 50 as mentioned above may have another function to retard the heat transfer from the lower surface of the precursor disk 10 and/or the lower surface 22 of the stabilising disk 20 to the counter piece 50 in place of or in addition to imparting a releasability. Thereby, the heating is effectively made.

Thus, if the thin layer is placed between the lower surface 22 of the stabilising disk 20 and the upper surface of the counter piece 50 for the purpose of retarding the heat transfer from the lower surface of the precursor disk 10 and/or the lower surface 22 of the stabilising disk 20 to the counter piece 50, the material for such thin layer can be any material as long as it does not adversely affect a good planarity (or flatness) of the contact surface of the lower surface 22 of the stabilising disk 20, which may not necessarily have a good releasability but should better have a property to retard the heat-transfer from the precursor disk 10 and/or stabilising disk 20 to the counter piece 50, preferably a heat-insulating material. Examples of such material having a property to retard the heat-transfer include, but are not limited to, thin paper, thin thermostable plastic or resin composite, thin heat-insulating ceramic or its composite and the like, which are widely available in the market.

Figure 4:
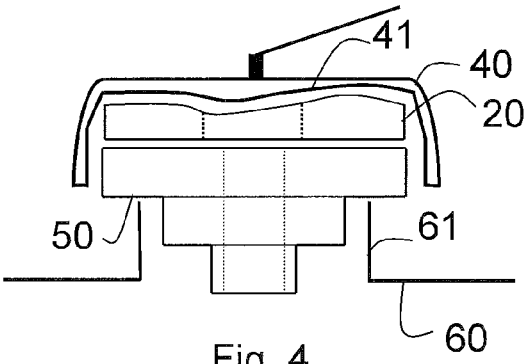
FIG. 4 shows a cross-sectional view of a flute to illustrate the use of the counter piece during the manufacturing process of the stabilising disk.

As shown in the cross-sectional view of the flute main body 60 in present FIG. 4, the diameter of the first disk-shaped portion 51 is larger than the diameter of the tone hole 61 of the flute 60. On the other hand, the diameter of the second disk-shaped portion 52 is smaller than the inner diameter of the tone hole 61 so that the counter piece 50 fits neatly into the tone hole 61.

As can also be seen in the cross-sectional view of FIG. 4, the diameter of the first disk-shaped portion 51 is slightly smaller than the inner diameter of the cup 40 so that the upper surface of the counter piece 50 presses against the lower surface of the stabilising disk 20 during the pressing and moulding action shown in FIG. 4. Typically, the inner diameter of the cup of a flute is about 1.5 to 2 mm larger than the diameter of the first disk-shaped portion 51 which is in turn also about 1.5 to 2 mm larger than the diameter of the tone hole 61. The diameter of the tone hole 61 is again about 1.5 to 2 mm larger in diameter than the diameter of the second disk-shaped portion 52. This allows a reliable stabilisation of the counter piece 50 within the tone hole 61 during the moulding and pressing process.

The thickness of the first disk-shaped portion 51 is about the same as the thickness of the pad assembly 30. This is important to guarantee that the cup 40 rests onto the counter piece 50 during the moulding process with the same possibly inclined angle as during actual use of the wind instrument when the pad assembly 30 is attached instead of the counter piece 50. Due to the fact that the cup 40 comes at rest at the same height as during actual use of the instrument, possible skewed angles of the key cup mechanism existing for this particular cup are perfectly modelled during the moulding process. Thereby, a stabilising disk 20 optimally formed to fit the mechanics of one particular key cup 40 can be manufactured. However, the thickness of the first disk-shaped portion 51 can be either slightly thinner or thicker than the thickness of the pad assembly 30, depending on the preference of the instrument player.

The third disk-shaped portion 53, which is optionally provided in the counter piece 50, has no particular function during the moulding process except (a) as an additional optional element for allowing easy gripping of the counter piece 50 and (b) as a discharge port for excess disk material (e.g. wax) squeezed out during the moulding process.

The central hole 54 continuously extending through each of the first to second and the optional third disk-shaped portions 51-53 serves as a discharge port for excess disk material (e.g. wax) squeezed out during the moulding process.

Figure 5:
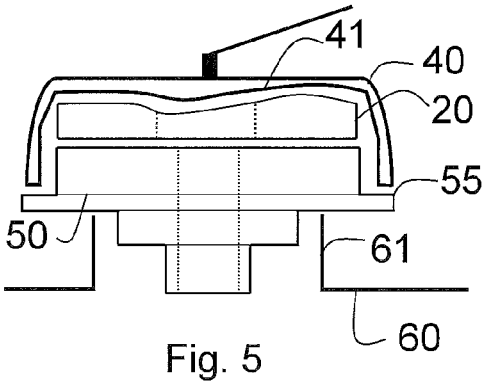
FIG. 5 shows another cross-sectional view of a flute to illustrate the use of a modified embodiment of the counter piece during the manufacturing process of the stabilising disk.

FIG. 5 shows the use of a modified embodiment of the counter piece 50. As shown in the drawing, the counter piece 50 includes a fourth disk-shaped portion 55 in addition to the first to third disk-shaped portions 51 to 53. The diameter of the fourth disk-shaped portion 55 is larger than the diameter of the first disk-shaped portion 51, and the fourth disk-shaped portion 55 is placed at an axial position between the first and second disk-shaped portions 51 and 52 so as to rest against the circumferential rim of the cup 40 when being inserted into the tone hole 61 before the cup 40 is being closed.

The additional advantage achieved by the modified embodiment according to FIG. 5 resides in that the fourth portion 55 abuts against the circumferential rim of the cup 40 during the reforming process of the stabilising disk 20 to stop the cup 40 from moving excessively far downward. This avoids the forming of a too thin stabilising disk 20 when a too high pressing force is applied to the cup 40 during the reforming process. Instead of further squeezing the disk 20 by the excessive force and removing the excess material through the throughhole 54, the downward movement of the cup 40 is stopped at a desired final position by the fourth disk-shaped portion 55 whose upper surface then abuts against the outer peripheral rim of the cup 40 and whose lower surface rests against the peripheral rim of the tone hole 61. It is again optional to have the third disk-shaped portion 53 in the modified embodiment of the counter piece 50 as shown in FIG. 5, and the modified embodiment may include a counter piece 50 consisting of the first disk-shaped portion, second disk-shaped portion and fourth disk-shaped portion.

In the embodiments of the present invention described above, a flute 60 has been used as an example of the wind instrument. However, the present invention is in no way limited thereto, and is applicable to any musical wind instrument which utilises opening and closing of tone holes when played by a player of the instrument, including a piccolo, clarinet, oboe, bassoon, saxophone and others.

According to the embodiment, an improved stabilising disk is provided. The disk is easy to be manufactured and allows the key pad to rest horizontally on the tone hole in its closed state even when the bottom wall within the key cup has an uneven surface and/or the key cup is placed in an oblique angle onto the tone hole due to an imprecise key mechanism.

According to the embodiment, an improved stabilising disk is provided. The disk is easily removable from the inner bottom wall of the cup at the time the musical instrument is repaired for renewal of the key pad assembly or in a maintenance process.

According to the embodiment, a better quality of a wind instrument is provided. In the wind instrument, the above-mentioned improved stabilising disk is provided to stabilise a pad assembly, thereby providing a better sound when played by a player of the instrument and/or minimising undesirable whistling sounds during his/her performance. "A better quality" used herein includes a milder sound, enabling a higher volume, and/or higher performance of the instrument such as an improved higher response. For example, a flute which incorporates the stabilising disk of the embodiment of the present invention enables the instrument player to play the instrument with a better quality such as an improved higher response even at a $C^3$-$C^4$ octave and/or a milder sound and/or higher volume. "An improved higher response" used herein means that at the time when a musician places his/her fingers on a key or plural keys of the instrument's key mechanism or key work which allows, upon direct or indirect (via a lever) actuation of the musician's fingers, for placing each key cup or each of a plurality of key cups onto each corresponding tone hole, each cup closes the corresponding tone hole in an airtight manner so instantly as to enable the instrument to pronounce (i.e., generate a tone) instantly or sharply.

According to the embodiment, a production method for the above-mentioned stabilising disk is provided. By the production method the manufacturing, maintenance or repairing process of a wind instrument becomes less cumbersome and/or less time-consuming and/or reduces a requirement of a high level of skills and expertise for such manufacturing, maintenance or repairing process.

The above benefits are obtained by a disk for stabilising a pad assembly in a key cup for closure of a wind instrument tone hole and is an integral body made of a material which is in a solid state at a room temperature and in a malleable state at a predetermined higher temperature.

The term "solid state" as used herein means that a material is in a physically-solid state, and preferably rigid. The term "malleable state" as used herein means that the physical state is in a molten or softened state, or plastically ductile. The term "integral body" as used herein means that the body is made of a structurally-single body, preferably having a substantially homogeneous physical or chemical composition throughout the body. The term "predetermined higher temperature" means the temperature at which a material in a solid state gets into a molten or softened state, or becomes plastically ductile.

The above benefits are obtained by the stabilising disk which is a disk for stabilising a pad assembly in a key cup for closure of a wind instrument tone hole and is an integral body made of a material which is in a solid state at a room temperature and in a malleable state at a predetermined higher temperature, and such disk has a shape in which the upper surface of the disk is complementary to the uneven surface of the inner bottom wall of the key cup.

The stabilising disk of the embodiment of the present invention is readily removable from the key cup as well as from a pad assembly in a manufacturing, repairing or maintenance process of a wind instrument.

The stabilising disk according to the embodiments of the present invention is obtainable by the production method described as herein below involving the use of a counter piece as described herein.

Preferably, the stabilising disk is formed of a hard wax material. A hard wax material is defined as a wax or waxy material which is solid, and preferably rigid, at an ambient temperature and is in a molten or softened state or becomes plastic or elastic at an elevated temperature. The hard wax material to be used in the embodiment of the present invention can be selected from those materials as petroleum derived wax and other synthetic wax or any natural wax or its modified wax as long as it is in a solid state, preferably rigid, at an ambient temperature and in a malleable state at a predetermined elevated (higher) temperature.

Examples of such petroleum derived wax and other synthetic wax include, but are not limited to, paraffin wax, microcrystalline wax, polyolefin wax such as a low molecular weight polyethylene or polypropylene wax, ester-type, ketone-type or amide-type fatty acid wax, hydrogenated wax, silicone-modified wax and the like. Certain natural wax or its modified wax can also be among such examples as long as it is in a solid state, preferably rigid, at an ambient temperature and in a malleable state at a certain elevated (higher) temperature.

References for such hard wax material are made in various literatures such as an article by A. H. Warth "*The Chemistry and Technology of Waxes*", Reinhold Publishing Corp. (1956), an article by H. Bennet "*Industrial Waxes*" Vol.1 (Chemical Publishing Co. (1963), product information website for Mitsui Hi-WAX™(http://www.mitsuichem-.com/service/polyurethane/coatings/hi-wax/spec.htm), product information website of Nippon Seiro Co., Ltd. (http://www.seiro.co.jp/e/product.html) and the like. The content of these articles is hereby incorporated by reference.

A more specific example of the hard wax material to be used in the embodiment of the present invention is Ferris File-A-Wax or File-A-Wax Green which is a general name of a waxy solid made of polyethylene, produced and/or sold by the companies Freeman Manufacturing & Supply Company, Otto Frei or Paul H. Gesswein. The Ferris File-A-Wax Green sold by Gesswein is a waxy solid, made of polyethylene having a melting point of 114-119° C. as described in its MSDS (http://www.gesswein.com/images/MSDS/File-A-Wax,-Green.pdf) which is hereby incorporated by reference. It is made of 100 wt % polyethylene having a melting point between 114° C. and 119° C., a boiling point of 660-730° F. (i.e., 349-388° C.) and a specific gravity of 0.98 as described in said MSDS. The Ferris File-A-Wax Green sold by Freeman is a waxy solid, made of polyethylene having a melting point of 228° F. (i.e., 109° C.), a specific gravity of 0.92 and Shore D Hardness of 55 as described in Freeman's Technical Data Sheet (http://www.freemanwax-.com/ferris-file-a-wax-green/) which is hereby incorporated by reference.

The use of the hard wax material allows for moulding the stabilising disk such that its upper surface is shaped to fit exactly into the uneven structure of the inner bottom wall of the key cup. Thus the upper surface of the stabilising disk of the embodiment of the present invention has a shape in which the upper surface of the disk is complementary to the uneven surface of the inner bottom wall of the key cup. Unlike bees wax or sealing wax, the hard wax material used in the embodiment of the present invention keeps an elastic but rigid condition at room temperature and becomes malleable only at higher temperatures which are not reached during ordinary use of the wind instrument.

The hard wax material used for the embodiment of the present invention is in a solid state, preferably rigid, having a medium degree of hardness with a Shore D hardness at room temperature which is not lower than 30, preferably not lower than 40, even more preferably within the range of 40 to 65, and most preferably within the range of 45 to 60, for example 50 or 55. The hard wax material becomes malleable at a predetermined higher temperature within the range of 50° C. to 150° C., preferably within the range of 60° C. to 120° C., and more preferably within the range of 70° C. to 90° C. The Ferris File-A-Wax Green sold by the companies Freeman and Gesswein has turned out to be one of the hard wax materials having excellent material characteristics for the intended use.

One of the features attained by the hard wax material used in the embodiment of the present invention is to provide the stabilising disk with a good releasability from the upper surface of the counter piece. Also, when the stabilising disk is required to be removed from the cup upon repairing the instrument or maintenance, one of the features attained by the hard wax material used in the embodiment of the present invention is to provide the stabilising disk with a good releasability from the inner bottom wall of the cup.

Such good releasability or better releasability can be attained by a hard wax material per se, or can be imparted by using a material which functions as a releasing agent (hereinafter called "releasing material") as a component comprised in a composition comprising a hard wax material, or by using a thin layer of a releasing material between the lower surface of the stabilising disk and the upper surface of the counter piece, or between the bottom wall of the cup and the upper surface of the stabilising disk, depending on the circumstances of the stabilising disk arrangement or of its production process. Examples of such releasing material include, but are not limited to, silicone or its modified silicone, both widely available in the market. Examples of such thin layer of a releasing material include, but are not limited to, a layer made of a paper, releasing paper, metal foil such as aluminium or copper foil, plastic film, ceramic sheet and the like, which are widely available in the market, (a) as long as it provides a good releasability of the stabilising disk from the bottom wall of the cup or from the counter piece, whichever the case may be and (b) as long as it does not adversely affect a good planarity (or flatness) of the contact surface of the lower surface of the stabilising disk in case it is used between the stabilising disk and the counter piece during the moulding process of the stabilising disk.

According to an important aspect of the embodiment of the present invention, the stabilising disk is produced from a precursor disk with flat, preferably uniformly flat, upper and lower surfaces. The precursor disk made of a disk material, such as a hard wax material, is positioned within the key cup to rest on its inner bottom wall, preferably at an ambient temperature. By heating the cup to a predetermined higher temperature, the disk material reaches its malleable state so that the precursor disk is mould into a form which is shaped complementary to the uneven inner surface of the bottom wall within the cup. During the moulding process, a predetermined pressure is applied against the precursor disk from at least one side of the precursor disk, preferably from the side which is not facing the inner wall of the cup.

Preferably, a specific counter piece is used for the pressing action during the moulding process. The counter piece is adapted to be inserted into the tone hole to allow the moulding process to be carried out in situ, i.e. in the wind instrument with its key mechanism being installed. The counter piece has at least two disk-shaped portions which are concentrically arranged to each other. The first disk-shaped portion has about the same thickness as the pad assembly and is configured to replace the pad assembly during the moulding process. The outer diameter of the first disk-shaped portion is larger than the outer diameter of the tone hole but smaller than the inner diameter of the key cup. The second disk-shaped portion has a smaller diameter than the inner diameter of the tone hole and is configured to stabilise the counter piece within the tone hole during the moulding and pressing process. A central throughhole of the counter piece allows discharge of excess disk material, such as hard wax, which is squeezed out during the moulding. After the moulding, the stabilising disk is cooled to reach its non-malleable rigid state. After some finishing processes, such as removing excess disk material in the centre and outer circumferential portions, the stabilising disk of the embodiment of the present invention has reached its final shape which means that it has a flat lower surface and a non-flat upper surface particularly complementary to the non-flat surface of the inner bottom wall of one particular cup.

According to an embodiment of the present invention, a method of producing a disk for stabilising a pad assembly in a key cup for closure of a wind instrument tone hole is provided, which comprises the steps of:

positioning a precursor disk in the key cup, wherein the precursor disk is an integral body made of a disk material which is in a solid state at room temperature and in a malleable state at a predetermined higher temperature, wherein a releasing material optionally exists, preferably as a thin layer, between the bottom wall of the key cup and the upper surface of the precursor disk;

positioning a counter piece in the tone hole of the wind instrument, wherein a thin layer to retard a heat-transfer is optionally placed between the lower surface of the precursor disk and the counter piece and/or wherein a releasing material optionally exists, preferably, as a thin layer, between the lower surface of the precursor disk and the upper surface of the counter piece;

closing the tone hole by the key cup with the counter piece being positioned between the tone hole and the key cup;

heating the precursor disk to a predetermined higher temperature at which the disk material gets into a malleable state;

pressing the key cup against the tone hole, thereby reforming the precursor disk into the stabilising disk; and cooling the stabilising disk to a temperature below said predetermined higher temperature so that the disk material gets into a solid state.

As it is obvious from the above method which comprises several steps including the positioning of the precursor disk in the cup and the positioning of the counter piece in the tone hole, the steps in the above method can be carried-out in any order as long as such order can provides a practical manufacturing method of the stabilising disk of the embodiment of the present invention.

It is also mentioned that the material of the musical wind instrument of the embodiment of the present invention or of the wind instrument to which the improved stabilising disk of the embodiment of the present invention or the production method of the embodiment of the present invention is applied is not limited. The invention can be applied to an instrument made of any material such as plastics, wood, thermosetting resins or its composite materials, aluminium or its alloy, silver or its alloy, gold or its alloy, brass or any other metal material.

Obviously, numerous modifications and variations of the present invention are possible in light of the above teachings. It is therefore to be understood that within the scope of the appended claims, the invention may be practiced otherwise than as specifically described herein.

What is claimed is:

1. A counter piece comprising:

a first disk-shaped portion; and a second disk-shaped portion concentrically arranged with the first disk-shaped portion and having a smaller diameter than the first disk-shaped portion, the second disk-shaped portion being to be positioned in a wind instrument tone hole during a manufacturing process of a stabilising disk adapted to stabilise a pad assembly in a key cup for closure of the tone hole, wherein the counter piece is not attached to the key cup so that the counter piece can be removed from the wind instrument tone hole after the manufacturing process.

2. The counter piece of claim 1, further comprising:

a centrally arranged throughhole extending from an upper surface of the counter piece to a lower surface of the counter piece.

3. The counter piece of claim 2, further comprising:

a third disk-shaped portion concentrically arranged with the first and second disk-shaped portions and having a smaller diameter than the second disk-shaped portion; and a fourth disk-shaped portion concentrically arranged with other disk-shaped portions, being axially positioned between the first and second disk-shaped portions and having a diameter which is large enough to close the key cup.

4. The counter piece of claim 2, further comprising:

a third disk-shaped portion concentrically arranged with the first and second disk-shaped portions and having a smaller diameter than the second disk-shaped portion, wherein the counter piece is made of a material selected from the group consisting of a plastics material, metal, glass, ceramic and graphite, in particular of aluminium, and wherein the counter piece is preferably an integral body.

5. The counter piece of claim 2, further comprising:

a third disk-shaped portion concentrically arranged with the first and second disk-shaped portions and having a smaller diameter than the second disk-shaped portion;

a fourth disk-shaped portion concentrically arranged with other disk-shaped portions, being axially positioned between the first and second disk-shaped portions and having a diameter which is large enough to close the key cup, wherein the counter piece is made of a material selected from the group consisting of a plastics material, metal, glass, ceramic and graphite, in particular of aluminium, and wherein the counter piece is preferably an integral body.

6. The counter piece of claim 2, further comprising:

a third disk-shaped portion concentrically arranged with the first and second disk-shaped portions and having a smaller diameter than the second disk-shaped portion.

7. The counter piece of claim 1, further comprising an additional disk-shaped portion concentrically arranged with other disk-shaped portions, being axially positioned between the first and second disk-shaped portions and having a diameter which is large enough to close the key cup.

8. The counter piece of claim 1, wherein the counter piece is made of a material which is the one selected from the group consisting of a plastics material, metal, glass, ceramic and graphite, in particular of aluminium, and wherein the counter piece is preferably an integral body.

9. The counter piece of claim 1, further comprising:

a third disk-shaped portion concentrically arranged with the first and second disk-shaped portions and having a smaller diameter than the second disk-shaped portion.

10. The counter piece of claim 1, further comprising:

a third disk-shaped portion concentrically arranged with the first and second disk-shaped portions and having a smaller diameter than the second disk-shaped portion; and a fourth disk-shaped portion concentrically arranged with other disk-shaped portions, being axially positioned between the first and second disk-shaped portions and having a diameter which is large enough to close the key cup.

11. The counter piece of claim 1, further comprising:

a third disk-shaped portion concentrically arranged with the first and second disk-shaped portions and having a smaller diameter than the second disk-shaped portion, wherein the counter piece is made of a material selected from the group consisting of a plastics material, metal, glass, ceramic and graphite, in particular of aluminium, and wherein the counter piece is preferably an integral body.

12. The counter piece of claim 1, further comprising:

a third disk-shaped portion concentrically arranged with the first and second disk-shaped portions and having a smaller diameter than the second disk-shaped portion;

a fourth disk-shaped portion concentrically arranged with other disk-shaped portions, being axially positioned between the first and second disk-shaped portions and having a diameter which is large enough to close the key cup, wherein the counter piece is made of a material selected from the group consisting of a plastics material, metal, glass, ceramic and graphite, in particular of aluminium, and wherein the counter piece is preferably an integral body.

13. A method of producing a disk for stabilising a pad assembly in the key cup for closure of a wind instrument tone hole, the method comprising:

positioning a precursor disk in a key cup, the precursor disk comprising an integral body made of a disk material which is in a solid state at room temperature and in a malleable state at a predetermined temperature higher than the room temperature;

positioning a counter piece in a tone hole of a wind instrument;

closing the tone hole by the key cup with the counter piece being positioned between the tone hole and the key cup;

heating the precursor disk to the predetermined temperature at which the disk material gets into a malleable state;

pressing the key cup against the tone hole to reform the precursor disk into the disk; and cooling the disk to a temperature below the predetermined temperature so that the disk material gets into a solid state, wherein the counter piece is not attached to the key cup so that the counter piece can be removed from the tone hole after the disk for stabilising the pad assembly is produced.

14. The method of claim 13, wherein the predetermined temperature is above 45° C.

15. The method of claim 14, wherein the predetermined temperature is within a range of 50° C. to 150° C.

16. The method of claim 14, wherein the predetermined temperature is within a range of 60° C. to 100° C.

17. The method of claim 14, wherein the predetermined temperature is within a range of 70° C. to 90° C.

18. The method of claim 13, wherein the counter piece comprises a first disk-shaped portion adapted to rest against a lower surface of the precursor disk during the pressing, and a second disk-shaped portion concentrically arranged with the first disk-shaped portion and having a smaller diameter than the first disk-shaped portion, a diameter of the first disk-shaped portion is larger than a diameter of the tone hole but smaller than an inner diameter of the key cup, and a diameter of the second disk-shaped portion is smaller than an inner diameter of the tone hole so that the second disk-shaped portion is completely inserted into the tone hole during the pressing.

19. The method of claim 18, wherein the counter piece further comprises a third disk-shaped portion.

20. The method of claim 13, wherein the predetermined temperature is above 45° C., preferably within a range of 50° C. to 150° C., more preferably within a range of 60° C. to 100° C., most preferably within a range of 70° C. to 90° C., and wherein the counter piece comprises a first disk-shaped portion adapted to rest against a lower surface of the precursor disk during the pressing, and a second disk-shaped portion concentrically arranged with the first disk-shaped portion and having a smaller diameter than the first disk shaped portion, a diameter of the first disk-shaped portion is larger than a diameter of the tone hole but smaller than an inner diameter of the key cup, and a diameter of the second disk-shaped portion is smaller than an inner diameter of the tone hole so that the second disk-shaped portion is completely inserted into the tone hole during the pressing.

21. The method of claim 13, wherein a thickness of the first disk-shaped portion is about equal to a thickness of the pad assembly.

22. The method of claim 13, wherein the predetermined temperature is above 45° C., preferably within a range of 50° C. to 150° C., more preferably within a range of 60° C. to 100° C., most preferably within a range of 70° C. to 90° C., and wherein a thickness of the first disk-shaped portion is about equal to a thickness of the pad assembly.

23. The method of claim 13, wherein the predetermined temperature is above 45° C., preferably within a range of 50° C. to 150° C., more preferably within a range of 60° C. to 100° C., most preferably within a range of 70° C. to 90° C., wherein the counter piece comprises a first disk-shaped portion adapted to rest against a lower surface of the precursor disk during the pressing, and a second disk-shaped portion concentrically arranged with the first disk-shaped portion and having a smaller diameter than the first disk-shaped portion, a diameter of the first disk-shaped portion is larger than a diameter of the tone hole but smaller than an inner diameter of the key cup, and a diameter of the second disk-shaped portion is smaller than an inner diameter of the tone hole so that the second disk-shaped portion is completely inserted into the tone hole during the pressing, and wherein a thickness of the first disk-shaped portion is about equal to a thickness of the pad assembly.

24. The method of claim 13, wherein the counter piece comprises a disk-shaped portion which comes to rest against a peripheral rim of the key cup during the pressing.

25. The method of claim 13, wherein the predetermined temperature is above 45° C., preferably within a range of 50° C. to 150° C., more preferably within a range of 60° C. to 100° C., most preferably within a range of 70° C. to 90° C., and wherein the counter piece comprises a disk-shaped portion which comes to rest against a peripheral rim of the key cup during the pressing.

26. The method of claim 13, wherein the predetermined temperature is above 45° C., preferably within a range of 50° C. to 150° C., more preferably within a range of 60° C. to 100° C., most preferably within a range of 70° C. to 90° C., wherein the counter piece comprises a first disk-shaped portion adapted to rest against a lower surface of the precursor disk during the pressing, and a second disk-shaped portion concentrically arranged with the first disk-shaped portion and having a smaller diameter than the first disk-shaped portion, and further comprises a third disk-shaped portion, a diameter of the first disk-shaped portion is larger than a diameter of the tone hole but smaller than an inner diameter of the key cup, and a diameter of the second disk-shaped portion is smaller than an inner diameter of the tone hole so that the second disk-shaped portion is completely inserted into the tone hole during the pressing, and wherein the counter piece comprises a fourth disk-shaped portion which comes to rest against a peripheral rim of the key cup during the pressing.

27. The method of claim 13, wherein the predetermined temperature is above 45° C., preferably within a range of 50° C. to 150° C., more preferably within a range of 60° C. to 100° C., most preferably within a range of 70° C. to 90° C., wherein the counter piece comprises a first disk-shaped portion adapted to rest against a lower surface of the precursor disk during the pressing, and a second disk-shaped portion concentrically arranged with the first disk-shaped portion and having a smaller diameter than the first disk-shaped portion, and further comprises a third disk-shaped portion, a diameter of the first disk-shaped portion is larger than a diameter of the tone hole but smaller than an inner diameter of the key cup, and a diameter of the second disk-shaped portion is smaller than an inner diameter of the tone hole so that the second disk-shaped portion is completely inserted into the tone hole during the pressing, wherein a thickness of the first disk-shaped portion is about equal to a thickness of the pad assembly, and wherein the counter piece comprises a fourth disk-shaped portion which comes to rest against a peripheral rim of the key cup during the pressing.

28. The method of claim 13, wherein, when positioning the precursor disk in the key cup, providing a releasing material between a bottom wall of the key cup and an upper surface of the precursor disk.

29. The method of claim 13, wherein, when positioning the counter piece in the tone hole of the wind instrument, placing a thin layer to retard a heat-transfer between a lower surface of the precursor disk and the counter piece.

30. The method of claim 29, wherein, when positioning the counter piece in the tone hole of the wind instrument, providing a releasing material between the lower surface of the precursor disk and an upper surface of the counter piece.

31. The method of claim 13, wherein, when positioning the counter piece in the tone hole of the wind instrument, providing a releasing material between a lower surface of the precursor disk and an upper surface of the counter piece.

32. The method of claim 13, wherein the counter piece comprises a first disk-shaped portion adapted to rest against a lower surface of the precursor disk during the pressing, and a second disk-shaped portion concentrically arranged with the first disk-shaped portion and having a smaller diameter than the first disk-shaped portion, wherein a diameter of the second disk-shaped portion is smaller than an inner diameter of the tone hole so that the second disk-shaped portion is completely inserted into the tone hole during the pressing, and wherein a centrally arranged throughhole extends from an upper surface of the counter piece to a lower surface of the counter piece.

* * * * *